US012797704B2

(12) United States Patent
McDuffie et al.

(10) Patent No.: US 12,797,704 B2
(45) Date of Patent: Nov. 17, 2026

(54) FLOATING WATER GAME DEVICE

(71) Applicants: Joey McDuffie, Tifton, GA (US); Richard McDuffie, Tifton, GA (US)

(72) Inventors: Joey McDuffie, Tifton, GA (US); Richard McDuffie, Tifton, GA (US)

( * ) Notice: Subject to any disclaimer, the term of this patent is extended or adjusted under 35 U.S.C. 154(b) by 1022 days.

(21) Appl. No.: 17/667,838

(22) Filed: Feb. 9, 2022

(65) Prior Publication Data

US 2023/0099130 A1 Mar. 30, 2023

Related U.S. Application Data

(60) Provisional application No. 63/249,328, filed on Sep. 28, 2021.

(51) Int. Cl.

| | |
|---|---|
| ***A63B 67/00*** | (2006.01) |
| ***A63B 71/02*** | (2006.01) |
| ***A63B 71/06*** | (2006.01) |
| ***A63B 71/14*** | (2006.01) |

(52) U.S. Cl.

CPC ..... *A63B 67/007* (2013.01); *A63B 67/002* (2013.01); *A63B 71/0672* (2013.01); *A63B 71/143* (2013.01); *A63B 2071/024* (2013.01); *A63B 2225/605* (2013.01)

(58) Field of Classification Search

CPC .. A63B 67/007; A63B 67/002; A63B 71/0672
See application file for complete search history.

(56) References Cited

U.S. PATENT DOCUMENTS

| | | | | | |
|---|---|---|---|---|---|
| 3,350,097 | A * | 10/1967 | Chevrette | A63B 63/08 | 273/350 |
| 3,430,958 | A * | 3/1969 | Lakeman | A63B 63/08 | 273/400 |
| 3,858,877 | A * | 1/1975 | Lundstrom | A63B 67/04 | 473/29 |
| 5,303,932 | A * | 4/1994 | Kessler | A63B 61/02 | 473/492 |
| 5,615,891 | A * | 4/1997 | Pankz | A63B 67/007 | 473/492 |
| 6,030,300 | A * | 2/2000 | Zheng | A63B 9/00 | 273/350 |
| 2006/0247072 | A1* | 11/2006 | Combs | A63B 63/00 | 473/348 |
| 2010/0071108 | A1* | 3/2010 | Plocher | A63B 71/081 | 2/19 |

(Continued)

*Primary Examiner* — Joseph B Baldori
*Assistant Examiner* — Christopher Glenn
(74) *Attorney, Agent, or Firm* — Brennan, Manna Diamond, LLC

(57) ABSTRACT

The present invention relates generally to the field of amusement devices. More specifically, the present invention relates to a floating water game device that is comprised of at least one net assembly, at least one primary anchoring pole, at least two secondary anchors, a ball, and at least one glove. The frame members of the device form a generally rectangular shape and are hollow such that the net assembly can float on water. The device is also comprised of anchors capable of retaining the net assembly in a position specified by the user against the forces of a body of water. In this manner, the device can be used in any body of water such that any number of people can enjoy the outdoors with family and friends.

11 Claims, 4 Drawing Sheets

(56) References Cited

U.S. PATENT DOCUMENTS

| | | | | |
|---|---|---|---|---|
| 2012/0184400 | A1* | 7/2012 | Orenstein | A63B 63/004<br>473/476 |
| 2018/0001171 | A1* | 1/2018 | Zavracky | A63B 63/06 |
| 2018/0043232 | A1* | 2/2018 | Perry | A63B 71/148 |
| 2019/0269993 | A1* | 9/2019 | Gonzales | A63B 67/007 |
| 2020/0032534 | A1* | 1/2020 | Crookham | A63B 63/004 |
| 2020/0238155 | A1* | 7/2020 | German | G09F 9/301 |

* cited by examiner

FLOATING WATER GAME DEVICE

CROSS-REFERENCE TO RELATED APPLICATION

The present application claims priority to, and the benefit of, U.S. Provisional Application No. 63/249,328 which was filed on Sep. 28, 2021 and is incorporated herein by reference in its entirety.

FIELD OF THE INVENTION

The present invention relates generally to the field of amusement devices. More specifically, the present invention relates to a floating water game device that is comprised of at least one net assembly, at least one primary anchoring pole, at least two secondary anchors, a ball, and at least one glove. The frame members of the device form a generally rectangular shape and are hollow such that the net assembly can float on water. The device is also comprised of anchors capable of retaining the net assembly in a position specified by the user against the forces of a body of water. In this manner, the device can be used in any body of water such that any number of people can enjoy the outdoors with family and friends. Accordingly, the present disclosure makes specific reference thereto. Nonetheless, it is to be appreciated that aspects of the present invention are also equally applicable to other like applications, devices and methods of manufacture.

BACKGROUND

Playing games outdoors can be a great way to enjoy warm weather, and a pool or other body of water can add to that fun. However, there are a limited number of games for a group of people to enjoy while spending time at the beach, lake, or swimming pool. By playing the same games repeatedly, people may get bored and look for other ways to spend their time. Further, many water games can only accommodate two to four people at a time, which may be inconvenient when spending time with a large group of people. Traditional water games may also have to continuously be repositioned as waves in the water may cause the game or structures used in the game to float away or be moved into an undesirable position.

Therefore, there exists a long-felt need in the art for a floating water game device. There also exists a long-felt need in the art for a floating water game device that can be played in any pool, lake, or other body of water. Further, there exists a long-felt need in the art for a floating water game device that can be played by a large group of people. In addition, there exists a long-felt need in the art for a floating water game device that can be anchored such that the device does not float away, rotate, or move into an undesirable position.

The subject matter disclosed and claimed herein, in one embodiment thereof, comprises a floating water game device. The device is comprised of at least one net assembly, at least one primary anchoring pole, at least two secondary anchors, a ball, and at least one glove. The frame members of the device form a generally rectangular shape and are flexible or semi-flexible such that the net assembly can float on water. The device is also comprised of anchors to position the net assembly to the preference of the user and hold the device in place against the forces of the water. In this manner, the device can be used in any body of water such that a group of any number of people can enjoy the outdoors with friends and family.

In this manner, the floating water game device of the present invention accomplishes all the forgoing objectives and provides a means to enjoy the outdoors with friends and family in any body of water. Further, the device can accommodate large groups of people as it does not have a maximum number of people who can play together. In addition, the device can anchor to a floor surface of a body of water such that the device may not float away or move into an undesirable position.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a floating water game device. The device is comprised of at least one net assembly, at least one primary anchoring pole, at least two secondary anchors, a ball, and at least one glove. The frame members of the device may form a generally rectangular shape and be made of a hollow material. However, the frame members are preferably made of a flexible or semi-flexible plastic material. In addition, any surface of the body may be comprised of a plurality of indicia such as patterns, logos, emblems, images, symbols, designs, letters, words, characters, animals, advertisements, brands, etc.

The device is comprised of at least one net assembly supported by two vertical frame members and at least one horizontal cross member, forming a generally rectangular shape. The tops of the vertical members are fixedly attached to either end of the horizontal cross member, of which a scoreboard is attached to assist users in keeping track of each team's points during the game. The bottoms of the vertical frame members are attached to either end of a rear support member. In one potential embodiment, the vertical frame members attach to the rear support member via at least one hinge, allowing the device to fold into itself and be easily stored and transported. At least one floatation device may also be attached to the rear support member, allowing the device to float on the surface of a body of water. Further, a netting may be secured to each frame member to capture a ball that passes through the net assembly, indicating a score.

Also attached to the rear support member may be at least one primary anchoring pole. The primary anchoring pole has a first end that attaches to the rear support member via at least one fastener. The second end of the primary anchoring pole penetrates the sand at the floor of a body of water, anchoring the device to that spot. To further anchor the device, at least one (but preferably two) secondary anchors may attach to the rear support member via a tether. A generally T-shaped handle body comprises the first end of the secondary anchor and allows a user to grip and press a pointed second end of the secondary anchor into the ground. In one potential embodiment, both the primary anchoring pole and the secondary anchors may be rigid and of a fixed length. However, in another potential embodiment, the primary anchoring pole and/or the secondary anchors may be adjustable in length. To adjust the length of the secondary anchor, a secondary handle body may fit in the hollow handle body and extend outward. The handle body may be comprised of a plurality of continuous openings through which a spring-loaded pin of the secondary handle body may insert into to temporarily give the device a fixed length. The primary anchoring pole may be adjustable in the same manner.

The device, in its preferred embodiment, is a game to be played in a body of water or a pool with two net assemblies positioned across from one another. Two teams, comprised of at least one player, work to pass, throw, or skip a ball into the net assembly of the other team while the other team tries to prevent the ball from going into their net assembly. A glove may be worn by the players of each team, or position-specific players, to aid in passing, catching, and defending during the game. The glove may be further comprised of fingers to comfortably fit a hand as well as padding and netting to assist in catching the ball. When a team passes the ball into the net assembly, that team scores a point, which may be recorded using the scoreboard attached to the horizontal cross member of the net assembly.

Accordingly, the floating water game device of the present invention is particularly advantageous as it allows a large group of people to play a game outdoors with friends and family in any body of water. Further, the device can be anchored in place to a floor surface of a body of water such that the device may not float away or move into an undesirable position due to waves or currents of the water. In addition, the device can accommodate any size group of people, as it can be played with as little as two people and has no maximum numbers of players at a single time. In this manner, the floating water game device overcomes the limitations of existing amusement games known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
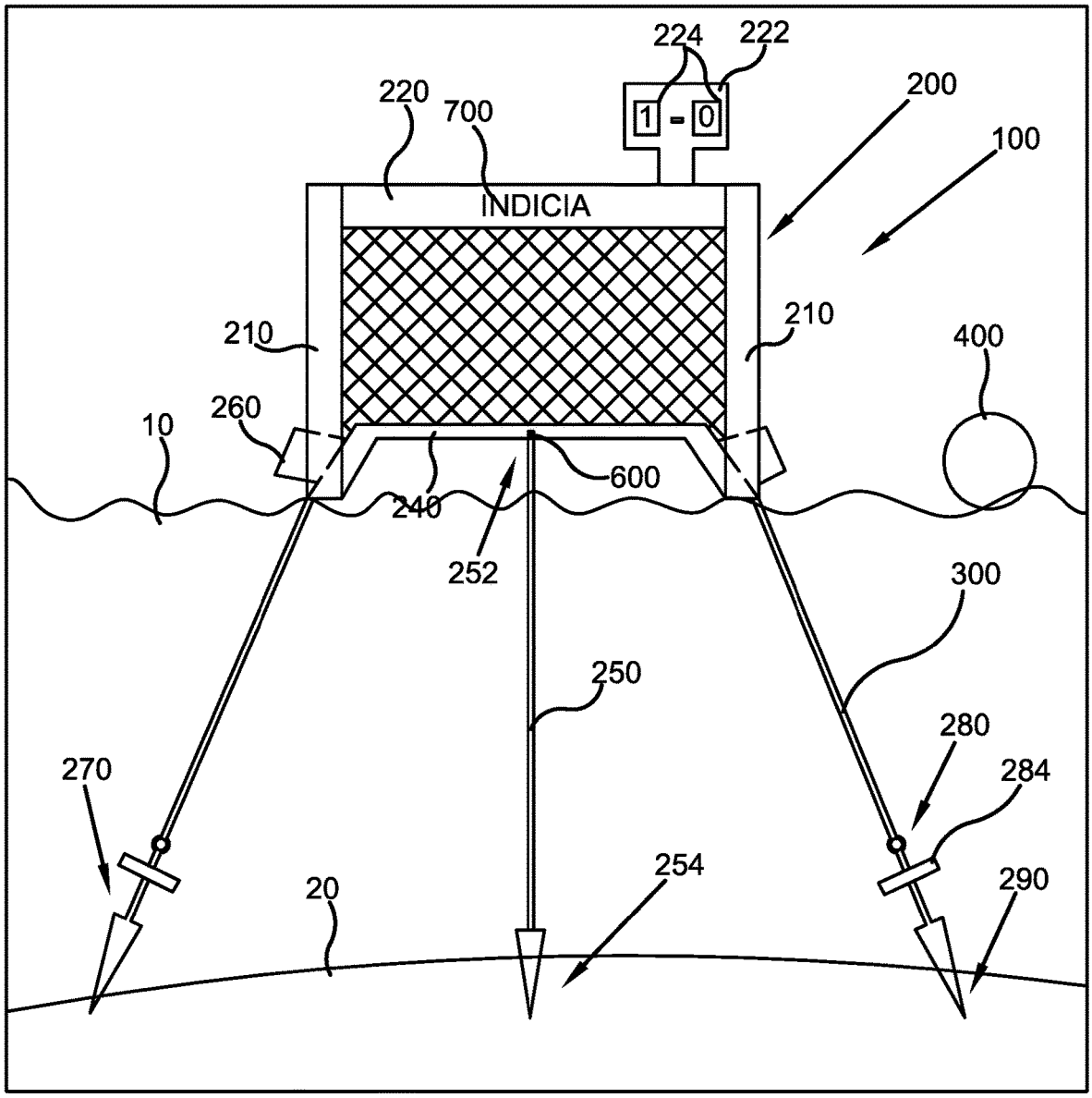
FIG. 1 illustrates a front perspective view of one potential embodiment of a floating water game device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a floating water game device. There also exists a long-felt need in the art for a floating water game device that can be played in any pool, lake, or other body of water. Further, there exists a long-felt need in the art for a floating water game device that can be played by a large group of people. In addition, there exists a long-felt need in the art for a floating water game device that can be anchored such that the device does not float away, rotate, or move into an undesirable position.

The present invention, in one exemplary embodiment, is comprised of a floating water game device that allows users to throw at least one ball into a floating net assembly while in a body of water such that multiple teams may compete and keep score, promoting outdoor fun. The device is primarily comprised of at least one net assembly, at least one primary anchoring pole, at least two secondary anchors, at least one ball, and at least one glove. The frame members of the device may form a generally rectangular shape and be made of a plurality of materials, but is preferably made of a flexible or semi-flexible plastic material. In addition, any surface of the body may be comprised of a plurality of indicia such as patterns, logos, emblems, images, symbols, designs, letters, words, characters, animals, advertisements, brands, etc.

The device is comprised of at least one net assembly further supported by two vertical frame members and at least one horizontal cross member. The vertical frame members are fixedly attached to either end of the horizontal cross member to give the net assembly a generally rectangular shape. However, in differing embodiments, the net assembly may have a round shape, a circular shape, or any other shape. A scoreboard may be fixedly or removably attached to the horizontal cross member of the net assembly. The scoreboard is comprised of scorecards to assist the users in keeping score during the game. The scorecards may be manually flipped to reveal a change in scoring.

A rear support member attaches to each vertical frame member on the end opposite the horizontal cross member to form a rigid frame of the device. In one potential embodiment, the rear support member attaches to each of the vertical frame members via at least one hinge, allowing the net assembly to fold for easy transportability and storage. Each of the vertical frame members, the horizontal cross member, and the rear support member may be hollow, allowing the device to float on water. At least one floatation device may be fixedly or removably attached to the rear support member to allow the device to float on water. A cap on each floatation device may open to allow the user to add water or another substance into the floatation device to adjust the buoyancy of the device. Further, a netting attaches to the horizontal cross member, vertical frame members, and rear support member such that when a ball passes through the net assembly, it may be caught in the netting, indicating a score. The netting may be made of any material or coating such that it does not easily degrade with excess exposure to water or sunlight.

At least one primary anchoring pole may fixedly or removably attach to the underside of the rear support member. The primary anchoring pole prevents the device from floating away and attempts to fix the device to a location despite the waves and currents of the body of water. The first end of the primary anchoring pole attaches to the rear support member via at least one fastener. The second end of the primary anchoring pole comes to a point to easily penetrate the floor of the body of water such as to anchor the device to that spot. At least two secondary anchors also attach to the rear support member. However, the secondary anchors may be attached to the rear support member via a tether. The first end of the secondary anchors is further comprised of a handle body. The handle body is generally T-shaped so the user can easily grip and press the secondary anchor into the ground. An eyelet is attached to the top of the handle body such that the tether can be tied off to that point. The second end of the secondary anchors also comes to a point similar to the second end of the primary anchoring pole to more easily penetrate the floor of the body of water.

In one potential embodiment, both the primary anchoring pole and the secondary anchors may be of a fixed and unchanging length. In another potential embodiment, the secondary anchors may be adjustable in length. In the embodiment with an adjustable secondary anchor length, the handle body of the first end may be comprised of a plurality of continuous openings. A secondary handle body may fit inside the handle body and extend outward to increase its length. A spring-loaded pin of the secondary handle body may insert into one of the continuous openings of the handle body to temporarily give the device a fixed length. The primary anchoring pole may also be adjustable in the same manner as the secondary anchor in one potential embodiment.

The design of the device is such that at least one ball may be thrown in the air or skipped across the surface of water to pass into the net assembly. The ball may be any size but preferably fits comfortably in one hand. The ball may also be made of a material such that it is capable of floating. The device may also be comprised of at least one glove to aid the users in catching the ball when it is passed between teammates. The glove may be comprised of fingers so a hand of the user may comfortably fit into the glove. The fingers of the glove may be padded to provide support when catching the ball. The glove may further be comprised of a netting such that when the glove is used to catch the ball, there is little impact on the hand itself, decreasing the risk of injury. The gloves may also be used in defense to stop the other team from scoring. In the preferred embodiment of the device, two net assemblies are placed in the water across from each other at a distance conducive of the amount of people that are playing the game. At least two people are required to play a game, forming two teams, but one person may practice on their own. When a team is in possession of the ball, they are trying to get the ball into the net assembly of the other team. The other team is trying to stop the other team from getting the ball into their net assembly. A team may score when the ball goes into the net assembly, and the scorecards of the scoreboard may indicate the change in points.

Accordingly, the floating water game device of the present invention is particularly advantageous as it allows a large group of people to play a game outdoors with friends and family in any body of water. Further, the device can accommodate large groups of people, as there is no maximum number of players and can be played with as little as two people. In addition, the device can be anchored to a spot in a body of water such that waves, currents, and other forces may not cause the device to float away or rotate to an undesirable position. Therefore, the floating water game device overcomes the limitations of existing amusement games known in the art.

Referring initially to the drawings, FIG. 1 illustrates a front perspective view of one potential embodiment of a floating water game device 100 of the present invention in accordance with the disclosed architecture. The device is comprised of at least one net assembly 200, at least one primary anchoring pole 250, at least one (but preferably two) secondary anchors 270, at least one ball 400, and at least one glove 500. In differing embodiments, the net assembly 200 may have the general appearance of a plurality of shapes such as but not limited to: a rectangle, a circle, an oval, a triangle, a pentagon, an ellipse, a square, etc. Further, the device 100 may be made of a plurality of lightweight materials, such as wood or aluminum, but is preferably made of a flexible or semi-flexible plastic such as but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc. In addition, the net assembly 200 may be transparent, semi-transparent, or opaque in differing embodiments. Furthermore, any surface of the device 100 may be comprised of any number of indicia 700 in the form of patterns, logos, emblems, images, symbols, designs, letters, words, characters, animals, advertisements, brands, etc.

In one embodiment, the at least one net assembly 200 is further supported by at least two generally parallel vertical frame members 210 and at least one horizontal cross member 220. The vertical frame members 210 are fixedly attached to either end of the horizontal cross members 220, giving the net assembly 200 a generally rectangular shape. However, the shape of the net assembly 200 may differ in differing embodiments of the device 100, as noted above. A scoreboard 222 may be fixedly or removably attached to the top of the horizontal cross member 220. The scoreboard 222 may be comprised of scorecards 224 to assist users in keeping score during the game. In one potential embodiment, the scoreboard 222 may have two sections, one for each team, that are different colors. Each section of the scoreboard 222 may contain a set of waterproof scorecards 224 that may be manually flipped over the top of the scoreboard 222 every time a team scores to keep track of the total points for each team.

A rear support member 240 attaches to the end of each vertical frame member 210. In one potential embodiment, the rear support member 240 is fixedly attached to the vertical frame members 210, making the structure sturdy and rigid. In another potential embodiment, the rear support member 240 may attach to the vertical frame members 210 via an at least one hinge 230. The hinge 230 allows the net assembly 200 to fold into itself, aiding in transporting and storing the device 100. The at least one hinge 230 may be any hinge type known in the art such as but not limited to: an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gas-piston hinge, an injection molded hinge, a locking hinge, etc.

The vertical frame members 210, horizontal cross member 220, and rear support member 240 are all preferably hollow to decrease weight and allow the net assembly 200 to float on water 10. To assist the device 100 in floating, at least one floatation device 260 may be fixedly or removably attached to the rear support member 240 via an at least one fastener 600. The floatation device 260 may be comprised of a cap 262 that allows the user to inject air, water, or another substance into the floatation device 260 to adjust the buoyancy of the floatation device 260 and the device 100. Further, a netting 232 attaches to the vertical frame members 210, the horizontal cross member 220, and the rear support member 240 to catch a ball 400 as it crosses into the net assembly 200. The netting 232 of the net assembly 200 may be made of any material, or a material may have any coating, such that the netting 232 does not easily degrade with excess exposure to water 10 and sunlight.

Figure 2:
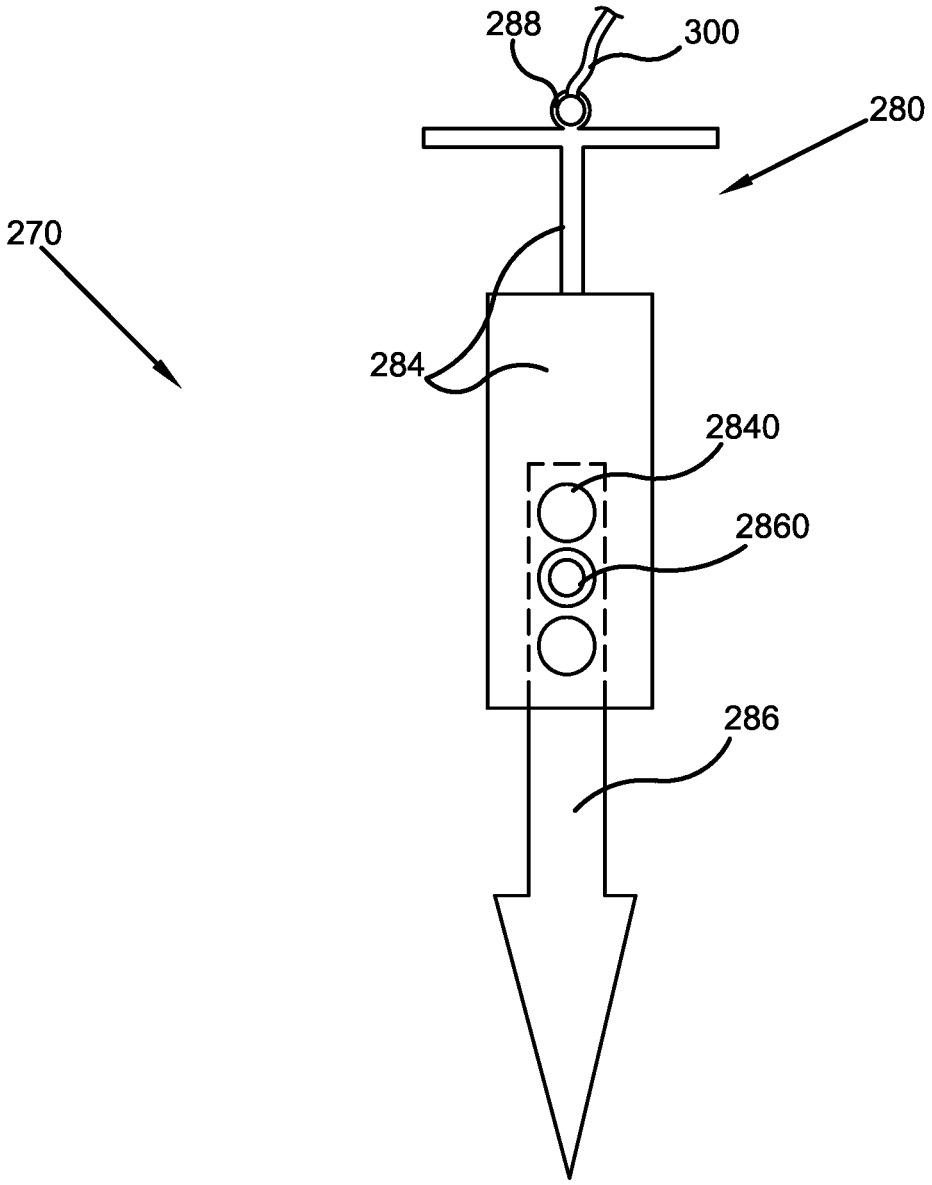
FIG. 2 illustrates an enhanced perspective view of one potential embodiment of a secondary anchor of one potential embodiment of a floating water game device of the present invention in accordance with the disclosed architecture.

FIG. 2 illustrates an enhanced perspective view of one potential embodiment of a secondary anchor 270 of one potential embodiment of a floating water game device 100 of the present invention in accordance with the disclosed architecture. The device 100 is further comprised of an at least one primary anchoring pole 250 and at least one (but preferably two) secondary anchors 270. The primary anchoring pole 250 prevents the device 100 from floating away by being placed into the sand 20 or other bottom surface 20 at the bottom of a body of water 10. The first end 252 of the primary anchoring pole 250 may be fixedly or removably attached to the rear support member 240 via an at least one fastener 600. The fastener 600 may be any fastener 600 such as but not limited to: a hinge, a screw, a bolt, a magnet, a hook-and-loop fastener, etc. The second end 254 of the primary anchoring pole 250 decreases in radius until coming to a point, allowing the second end 254 to penetrate the sand 20 or other bottom surface 20 at the bottom of the body of water 10 to allow the pole 250 to more easily anchor the device 100 to said spot. At least one (but preferably two) secondary anchors 270 are also fixedly or removably attached to the rear support member 240. The secondary anchors 270 may be attached to the rear support member 240 via at least one fastener 600 but are preferably attached via a tether 300. The first end 280 of the secondary anchor 270 is comprised of a generally T-shaped handle body 284, allowing the user to easily grip and press the secondary anchor 270 into the sand 20 or bottom surface 20. An eyelet 288 attaches to the top of the handle body 284 such that a tether 300 can be tied around the eyelet 288. The second end 290 of the secondary anchors 270 also come to a point in a similar manner to the second end 254 of the primary anchoring pole 250, allowing the second end 290 of the secondary anchors 270 to penetrate the sand 20 or bottom surface 20 easily. In an embodiment of the device 100 that is intended to be used within a pool, the anchoring pole 250 and secondary anchors 270 may not have a pointed end 254, 290 wherein the pole 250 and anchors 270 merely contact the bottom surface 20 of the pool and wherein the weight of the pole 250 and anchors 270 themselves prevents the device 100 from moving.

In one potential embodiment of the device 100 (as best seen in FIG. 2), the secondary anchors 270 may be of an adjustable length. In this embodiment, the handle body 284 of the first end 280 of the secondary anchors 270 may be comprised of a plurality of continuous openings 2840. The continuous openings 2840 may be spaced evenly along the surface of the handle body 284, and the handle body 284 may also be hollow. Thus, a secondary handle body 286 may fit inside the handle body 284 and can extend outward to increase the length of the secondary anchor 270. A spring-loaded pin 2860 of the secondary handle body 286 may extend from the secondary handle body 286 and insert into at least one of the continuous openings 2840 of the handle body 284. Once the spring-loaded pin 2860 is inserted into a continuous opening 2840, the secondary anchor 270 has a temporarily fixed length. To adjust the length of the secondary anchor 270, the user can push the spring-loaded pin 2860 inwards and extend out or push in the secondary handle body 286 until the spring-loaded pin 2860 reaches the next continuous opening 2840. In another potential embodiment, the primary anchoring pole 250 may also be adjustable in the same manner as the secondary anchor 270.

Figure 3:
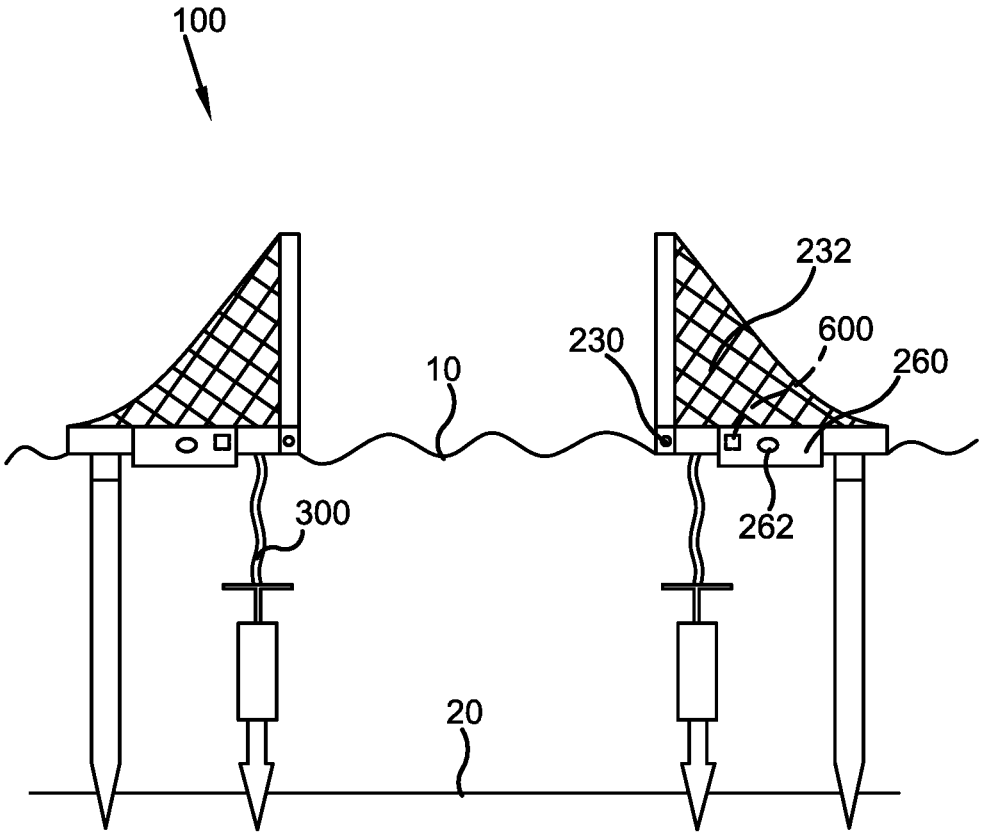
FIG. 3 illustrates a side perspective view of one potential embodiment of multiple floating water game devices of the present invention in accordance with the disclosed architecture.
Figure 4:
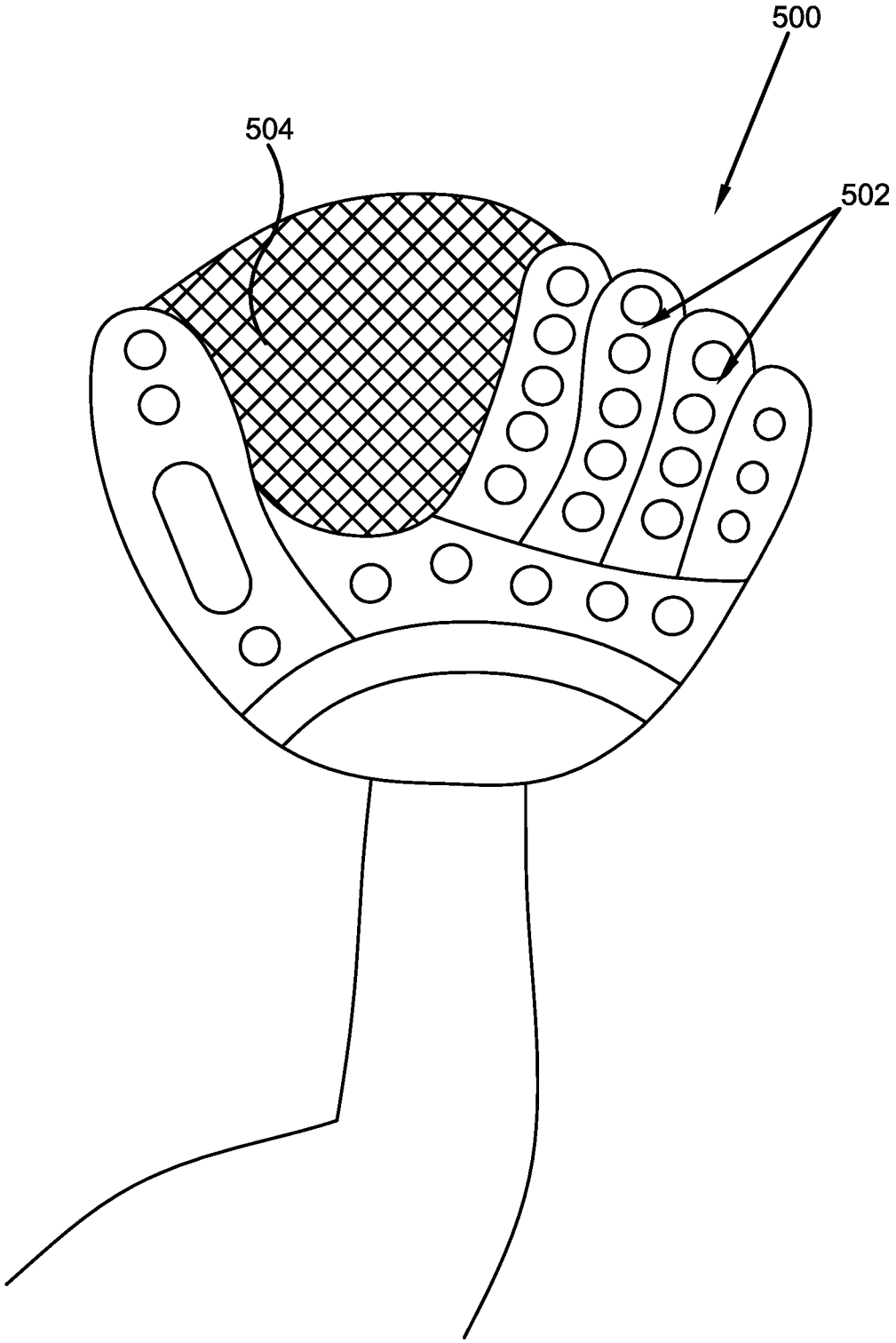
FIG. 4 illustrates a perspective view of one potential embodiment of a glove of one potential embodiment of a floating water game device of the present invention in accordance with the disclosed architecture.

FIG. 3 illustrates a side perspective view of one potential embodiment of multiple floating water game devices 100 of the present invention in accordance with the disclosed architecture. The device 100 is intended to be used such that two net assemblies 200 are set up in water 10 across from each other. Two teams, each comprised of at least one player, aim to get a buoyant ball 400 into the net assembly 200 of the other team. The ball 400 may be made of a rubber, or like, material such that it can easily skip across the water 10 and float on the water 10. Each time the ball 400 hits the back of the net assembly 200, the team scores and is awarded a point. Teammates may pass the ball 400 to one another, easily catching the ball 400 with a glove 500 (as best seen in FIG. 4). The glove 500 may also be used by the defensive team to intercept the ball 400 or prevent the ball 400 from going into their net assembly 200. The glove 500 is further comprised of a plurality of fingers 502 and a netting 504. The fingers 502 of the glove 500 allow a user's hand to easily fit into the glove 500 and squeeze around the ball 400. The fingers 502 may also have additional padding to prevent injury when catching a ball 400 that is moving at a high speed. The netting 504 of the glove 500 further aids the user in catching the ball 400 by decreasing the elasticity of the collision such that the ball 400 remains in the netting 504 of the glove 500.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "floating water game device" and "device" are interchangeable and refer to the floating water game device 100 of the present invention.

Notwithstanding the forgoing, the floating water game device 100 of the present invention and its various components can be of any suitable size and configuration as is known in the art without affecting the overall concept of the invention, provided that they accomplish the above-stated objectives. One of ordinary skill in the art will appreciate that the size, configuration and material of the floating water game device 100 as shown in the FIGS. are for illustrative purposes only, and that many other sizes and shapes of the floating water game device 100 are well within the scope of the present disclosure. Although the dimensions of the floating water game device 100 are important design parameters for user convenience, the floating water game device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A floating water game device comprising:

a net assembly comprising a horizontal cross member, a pair of vertical members attached to the horizontal cross member at opposite ends of the horizontal cross member, and a rear support member hingedly attached to each of the vertical members;

a primary anchoring pole attached to the net assembly;

a secondary anchor attached to the net assembly;

a ball;

a glove comprising a plurality of fingers and a netting; and a tether that attaches the secondary anchor to the rear support member; and wherein the secondary anchor is adjustable in length; and wherein the secondary anchor further comprises a T-shaped handle body first end comprising an eyelet and a plurality of openings and a secondary handle body comprising a pointed end and extendable out of the T-shaped handle body first end; and further wherein the secondary handle body further comprises a spring-loaded pin insertable into the plurality of openings of the T-shaped handle body first end.

2. The floating water game device of claim 1, wherein the net assembly is comprised of a material that allows it to float on water.

3. The floating water game device of claim 1, wherein the primary anchoring pole and the secondary anchor maintain the floating water game device within a desired location.

4. The floating water game device of claim 1, wherein a second end of the primary anchoring pole is pointed.

5. A floating water game device comprising:

a net assembly;

a pair of vertical frame members;

a horizontal cross member;

a rear support member hingedly attached to each of the vertical members via a gas-piston hinge;

a flotation device attached to the rear support member configured to allow a user to inject air into the flotation device;

a scoreboard comprising two sets of waterproof flip scorecards;

a primary anchoring pole attached to the net assembly;

a secondary anchor attached to the net assembly;

a buoyant ball;

a glove having a plurality of fingers and a netting; and a tether attaching the secondary anchor to the net assembly; and wherein the secondary anchor is adjustable in length and comprises a handle body first end comprising a plurality of openings and a secondary handle body extendable out of the handle body first end for adjusting a length of the secondary anchor; and further wherein the secondary handle body comprises a spring-loaded pin insertable into the plurality of openings of the handle body first end.

6. The floating water game device of claim 5, wherein the net assembly is comprised of a material that floats on water.

7. The floating water game device of claim 5, wherein the primary anchoring pole and the secondary anchor maintain the floating water game device within a desired location.

8. The floating water game device of claim 5, wherein a first end of the secondary anchor is T-shaped.

9. The floating water game device of claim 5, wherein a second end of the primary anchoring pole is pointed.

10. The floating water game device of claim 5, wherein a second end of the secondary anchor is pointed.

11. A floating water game device comprising:

a net assembly comprising a horizontal cross member, a pair of vertical members attached to the horizontal cross member at opposite ends of the horizontal cross member, and a rear support member hingedly attached to each of the vertical members;

a flotation device attached to the rear support member and comprising a cap configured to allow a user to inject air into the flotation device;

a primary anchoring pole;

a pair of secondary anchors;

a ball; and at least one glove comprising a plurality of fingers and a netting; and wherein the primary anchoring pole is attached to the rear support member via a magnetic fastener;

wherein each secondary anchor comprises a handle body first end comprising a plurality of openings and a secondary handle body extendable out of the first handle body first end for adjusting a length of each secondary anchor; and further wherein the primary anchoring pole is extendable in length.

* * * * *